United States Patent [19]

Bennet, deceased

[11] Patent Number: 4,878,549

[45] Date of Patent: Nov. 7, 1989

[54] WIRE LINE CORE BARREL

[75] Inventor: Andrew H. Bennet, deceased, late of Newcastle-upon-Tyne, England, by David H. Davies, executor

[73] Assignee: Diamant Boart Cralius Ltd., Daventry, England

[21] Appl. No.: 256,509

[22] Filed: Oct. 12, 1988

Related U.S. Application Data

[63] Continuation-in-part of Ser. No. 135,500, Dec. 18, 1987, abandoned, which is a continuation of Ser. No. 882,235, Jul. 7, 1986, abandoned.

[30] Foreign Application Priority Data

Jul. 9, 1985 [GB] United Kingdom ..... 8717388

[51] Int. Cl.[4] ..... E21B 25/04

[52] U.S. Cl. ..... 175/248; 175/258; 175/260; 175/289

[58] Field of Search ..... 175/246, 248, 257–261, 175/273, 284, 286, 285, 289, 292, 58

[56] References Cited

U.S. PATENT DOCUMENTS

| | | | |
|---|---|---|---|
| 1,162,441 | 11/1915 | Bloss | 175/258 |
| 1,502,463 | 7/1924 | Dunsworth | 175/261 |
| 1,996,132 | 4/1935 | Walker | 175/258 |
| 2,842,343 | 7/1958 | Church et al. | 175/258 |
| 3,603,411 | 9/1971 | Link | 175/259 |
| 4,497,382 | 2/1985 | Nenkov | 175/260 |

FOREIGN PATENT DOCUMENTS

| | | | |
|---|---|---|---|
| 579403 | 11/1977 | U.S.S.R. | 175/258 |
| 777198 | 1/1980 | U.S.S.R. | 175/257 |
| 1049653 | 10/1983 | U.S.S.R. | 175/258 |

*Primary Examiner*—Hoang C. Dang

*Attorney, Agent, or Firm*—Vaden, Eickenroht, Thompson & Boulware

[57] ABSTRACT

A core sampling device comprising a drill bit assembly, a drive shoe arranged to house the drill bit, a core sampling tube and a retraction tube. The drill bit assembly includes a bit housing, which is drivingly engaged by the drive shoe, and a series of drill segments which are pivotally attached to the housing to be capable of pivoting between a drilling position and a retracted position. The segments are maintained in the drilling position by the core sampling tube when this is in a forward position, but are allowed to adopt the retracted position when the sampling tube is withdrawn. The core sampling tube engages the drill bit assembly via the retraction tube whereby continued withdrawal of the core sampling tube causes withdrawal of the drill bit assembly from within the drive shoe.

5 Claims, 3 Drawing Sheets

WIRE LINE CORE BARREL

This application is a continuation-in-part of my prior application, Ser. No. 135,500, filed Dec. 18, 1987, and entitled "Wire Line Core Barrel", now abandoned, which was in turn a continuation of Ser. No. 882,235, filed July 7, 1986, and entitled "Wire Line Core Barrel", now abandoned.

BACKGROUND OF THE INVENTION

The present invention relates to a core sampling device, in particular a drill bit and core barrel assembly for a wire-line drilling method of obtaining core samples.

In a commonly known wire-line core sampling device, the drill bit comprises effectively an annular cutting device which cuts an annular or cylindrical hole. This hole defines a core which is captured within a core barrel for sampling.

Devices of this kind suffer the disadvantage that it is not possible to change the drill bit e.g. to accommodate changes in geological conditions or simply to replace a worn bit, without withdrawing the entire drill line.

SUMMARY OF THE INVENTION

It is an object of the present invention to provide a core sampling device in which the drill bit can be changed without withdrawing the entire drill line.

According to the invention there is provided a core sampling device for connection to a drilling machine through at least one drilling rod and an outer barrel attached to the drilling rod most distant from said drilling machine, said sampling device comprising a drill bit assembly, a generally cylindrical drive shoe drivingly coupled to said outer barrel and arranged to house said drill bit assembly, and a core sampling tube; said drill bit assembly including a bit housing and a series of drill segments; said bit housing including first engagement means on an external surface thereof and said drive shoe including second engagement means on an internal surface thereof, whereby, when said bit housing is located within said drive shoe, said first and second engagement means engage each other so that when rotational force from said drilling machine is applied to said drive shoe via said drilling rods and said outer barrel, said bit housing is drivingly engaged by said drive shoe through the first and second engagement means; each drill segment comprising an elongate body having a convexly curved engagement section at one end and a cutting portion at the other end, said cutting portion having an inner radial limit and an outer radial limit; said bit housing having a series of elongate slots, each slot being open at one end of said bit housing and having an enlarged recess at the other end thereof and each recess defining a concavely curved internal support section around the inside thereof; each drill segment being located with its elongate body within one of said elongate slots and with said curved engagement section received within said curved support section of said recess to define a curved hinge profile whereby each drill segment is capable of pivoting, without any translation movement, relative to said bit housing between a drilling position, in which said outer and inner radial limits of said cutting portions define the outer and inner diameter of an annular hole to be drilled, and a retracted position in which said cutting faces are entirely within the diameter of said generally cylindrical drive shoe; said drill segments being maintained in said drilling position with said elongate bodies held in said elongate slots by means of said core sampling tube when said core sampling tube is in a forward position within said bit housing; and said segments being allowed to adopt said retracted position with said elongate bodies extending into the interior of said bit housing when said sampling tube is withdrawn; said core sampling tube engaging said drill bit assembly whereby continued withdrawal of said core sampling tube causes withdrawal of said drill bit assembly from within said drive shoe.

Thus, the bit can be removed together with the core, without having to withdraw the entire drill line.

Preferably, the device includes a retraction tube which is connected to the drill bit housing and which is engaged by the core sampling tube on its withdrawal in order to withdraw the drill bit assembly. Preferably, the core sampling tube houses a core spring.

Preferably, the drive shoe has a screw thread for connection to an outer tube of a drill line and the core sampling tube has connecting means for connection to an inner tube of a drill line.

Preferably, the said connecting means provides a connection allowing a limited rocking movement between the core sampling tube and the inner tube.

It will be appreciated that the preferred construction may ensure correct movement of the bit segments into their correct mode. It will also provide a sufficient degree of freedom to accommodate the core without damaging the core, and also allows a considerably flow of lubricant for cooling and the removal of pulverized material.

The invention may be carried into practice in various ways and one embodiment will now be described by way of example with reference to the accompanying drawings.

DESCRIPTION OF PREFERRED EMBODIMENTS

Figure 2:
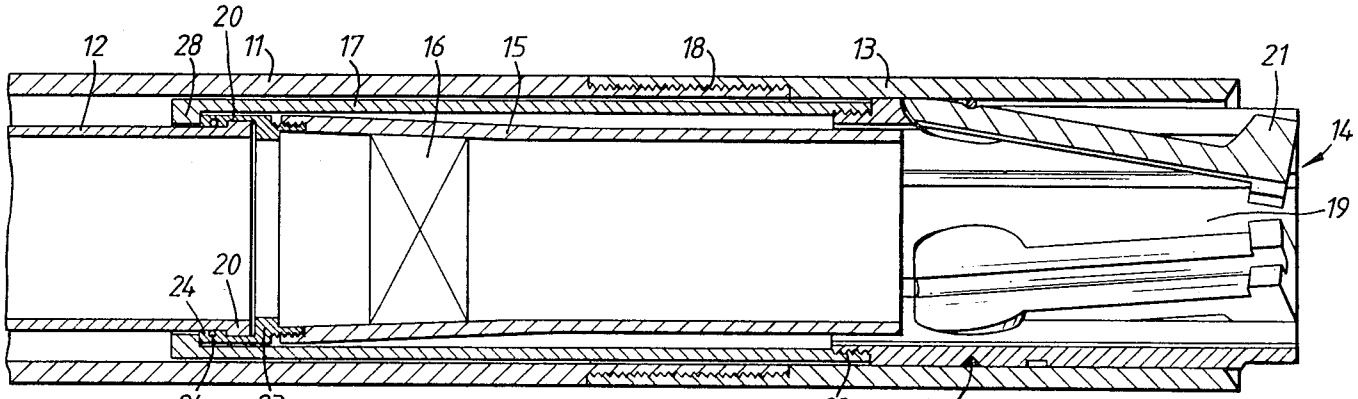
FIG. 2 is a view similar to FIG. 1 with the device in its retracted mode.
Figure 3:
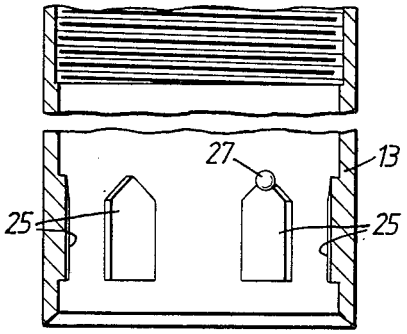
FIG. 3 is a partial cut-away view of a drive shoe.
Figure 4:
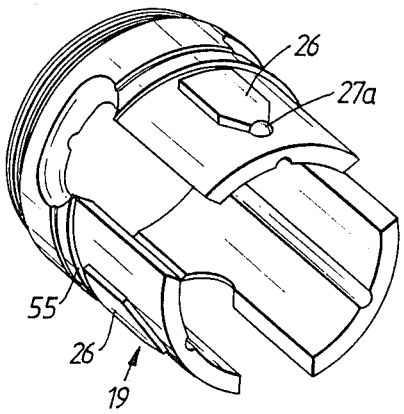
FIG. 4 is a perspective view of a bit body.
Figure 5:
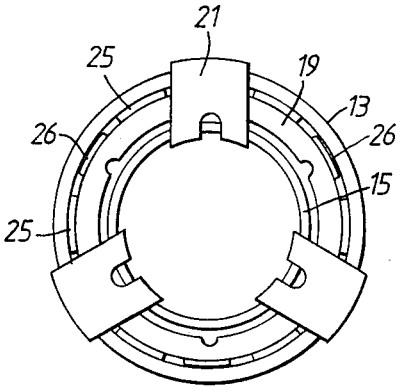
FIG. 5 is an end view of the device in its drilling mode.
Figure 6:
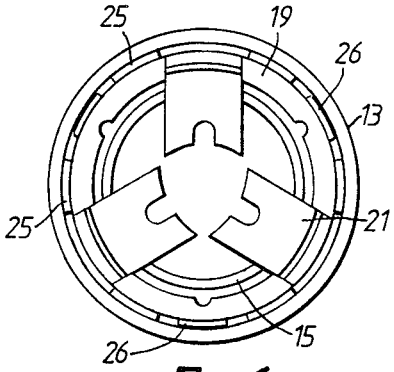
FIG. 6 is an end view of the device in its retracted mode.
Figure 7:
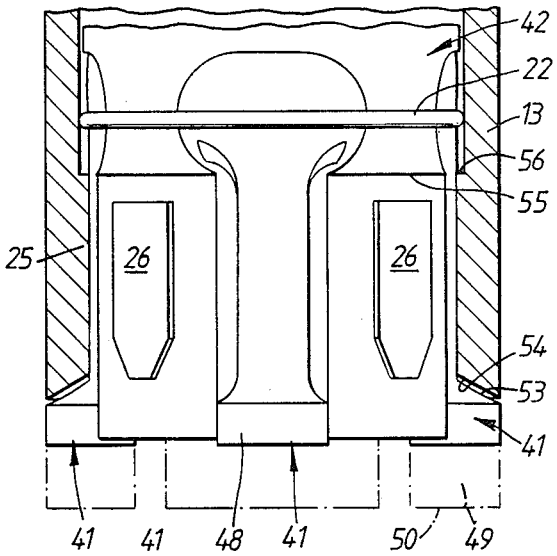
FIG. 7 is a cutaway view of a bit according to an alternative embodiment
Figure 9:
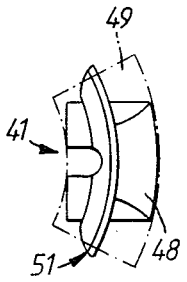
FIG. 9 is a plan view of a bit segment.
Figure 8:
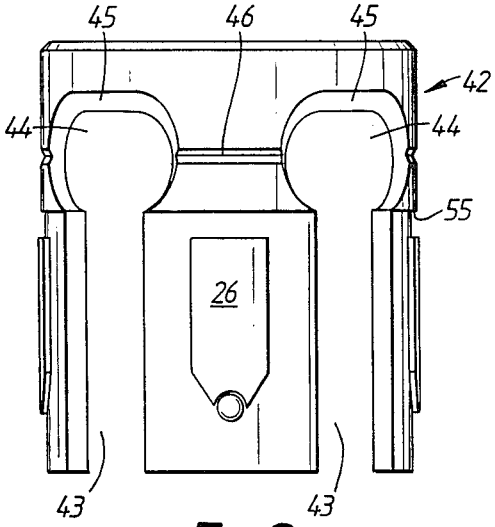
FIG. 8 a side view of the bit housing of FIG. 7, rotated through 45°.
Figure 10:
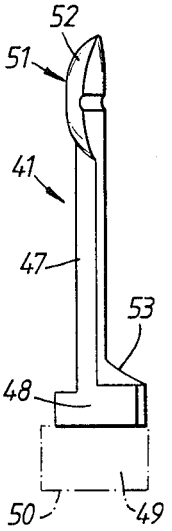
FIG. 10 is a side view of a bit segment.

The drill line at the bit end is shown schematically as comprising an outer tube 11 and an inner tube 12. The sampling device comprises a drive shoe and reaming shell 13, a bit 14, a core spring carrier tube 15 housing a core spring 16, and a retraction tube 17. The drive shoe 13 is connected to the outer tube 11 by a screw thread connection 18. The bit 14 comprises a bit housing 19 (which in FIG. 2 is shown in a simplified schematic form for reasons of clarity) and a series (in this case 3) of hinged cutting segments 21.

The bit housing 19 is connected to the retraction tube through a screw thread connection 29. The bit housing 19 includes three slots in which the bit segments 21 are located, as will be described in more detail with reference to FIGS. 7 to 10 below. The bit segments 21 are held in position by means of a spring 22 in the form of a split ring. The housing 19 and segments 21 are formed with a circumferential groove in which the spring is seated, again as will be described in more detail with reference to FIGS. 7 to 10 below.

The spring carrier 15 is connected to the inner tube 12 via a split attachment member 23 which is threadably connected to the spring carrier 15. The inner tube 12 has a terminal external flange 20 which engages a corresponding internal flange 24 on the attachment member 23. This engagement is non-rigid, thereby allowing some relative movement between the inner tube 12 and the carrier 15 to accommodate small misalignments as the core sample passes up the carrier 15. A ball race **24*a* may be included at the inner flange 24** to assist this relative movement or swivelling.

In an alternative embodiment (not shown), the spring carrier 15 is in two parts, the top part being split and having an internal flange (similar to the flange 24) which engages the external flange 20 on the inner tube 12, thereby locking the carrier 15 over the inner tube 12.

Figure 1:
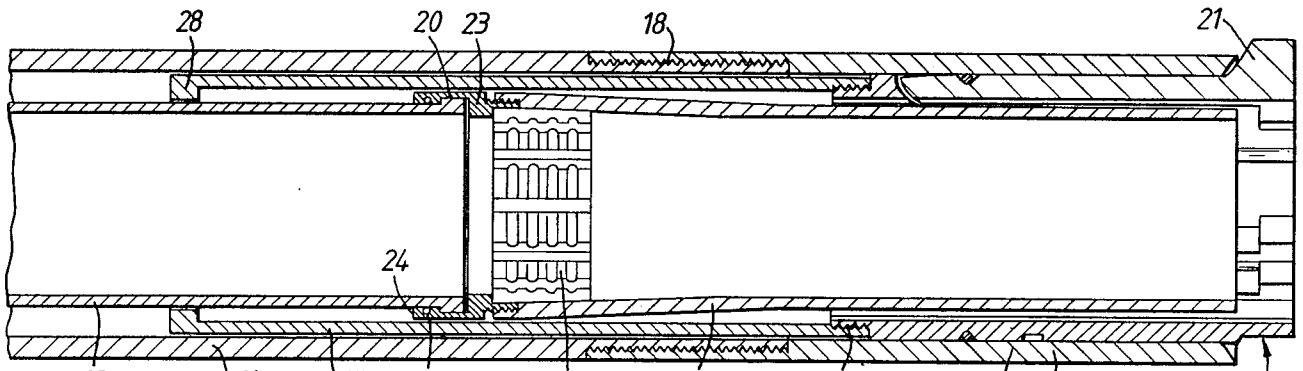
FIG. 1 is a simplified longitudinal section through a sampling device according to the invention in its drilling mode.

When the device is in its drilling mode, the carrier tube 15 is located in a forward position as shown in FIG. 1. In this position, the segments 21 are forced to adopt an outwardly extended orientation by the forward portion of the tube 15, so that the radially outer extent of the cutting segments 21 define the outer diameter of the annular hole which is to cut, while the radially inner extent of the segments 21 define the inner diameter of the annular hole.

The drive to the bit is supplied by the outer tube 11 which, through the connection 18, drives the drive shoe 13 which in turn drives the bit housing 19. The drive shoe 13 has a series of internal drive keys 25 which co-operate with corresponding drive keys 26 on the outer surface of the bit housing 19. Thus, these components rotate relative to the inner tube 12 and carrier tube 15. To help ensure that the keys 25,26 do not simply abut longitudinally, ball guides 27, **27*a* are provided at one or more of the keys 25,26 respectively. These tend to cause the keys 25,26 to slide past each other and so guide the segments 21** into the correct position for drilling.

As drilling proceeds and the drill line descends through rock strata, the segments 21 cut an annular hole. The pulverized material is removed by means of water which is pumped to the drilling position and which passes back to the surface around the outside of the drill line. Its passage may be aided by axially-extending grooves on the inner surface of the bit housing 19 and the bit segments 21, and by the fact that the retraction tube 17 can optionally be perforated, though the tube 17 in the illustrated embodiment is not. The rock core thus produced effectively passes up the centre of the carrier tube 15.

When it becomes desirable to remove the core and/or the drill bit 14, drilling is stopped and the inner tube 12 is drawn upwards. This withdraws the carrier tube 15 together with the core, which is held in position by the spring 16. Withdrawal of the carrier tube allows the segments 21 to pivot inwards to a retracted position in which their radially outward margins are contained within the diameter of the drive shoe 13.

Continued withdrawal of the inner tube 12 and the carrier tube 15 causes the attachment member 23 to abut an inwardly extending flange 28 at the end of the retraction tube 17. Further withdrawal draws up the retraction tube 17 and also the drill bit 14 which is connected to the retraction tube 17 by means of the screw thread connection 29 between the tube 17 and the bit housing 19.

Thus, the drill bit 14 can be changed if required without the necessity of removing the entire drill line. The bit segments 21 can have cutting faces (kerf) which are surface-set with diamonds, or matrix impregnated with diamond grit. Alternatively, the cutting medium may be a hard material such as tungsten carbide or indeed the bit segments 21 can carry pads which are of tungsten carbide faced with diamond grit, as may be appropriate to the geological conditions. In the illustrated embodiment no cutting elements are shown on the bit segments 21 .

FIGS. 7 to 10 illustrate a bit according to an alternative embodiment in which there are four bit segments 41, though in other respects the segments 41 and the bit housing 42 are similar to the corresponding elements in the first embodiment. These elements will therefore be described in detail with respect to FIGS. 7 to 10 but it is to be understood that the description is equally applicable to the embodiment of FIGS. 1 to 6. Indeed, as few as two bit segments may be employed or as many as five or more.

The bit housing 42 includes four elongate slots 43 extending in the axial direction and which are open at their lower ends. At their upper ends, each slot 43 ends in a larger recess 44 which whose front side a concavely curved internal support section 45 around the inside of the recess 44. A circumferential groove 46 is formed around the bit housing 42 in the region of the recesses 44 to accommodate the spring 22. The keys 26 are located on the walls of the bit housing 42 between the slots 43.

The upper part of the bit housing 42 is separated from the lower part (which has a slightly smaller diameter) by a shoulder 55. The drive shoe is formed internally with a corresponding lip 56. Thus, when the bit assembly 14 is in the correct position for drilling, the shoulder 55 engages the lip 56, thus preventing the bit assembly 14 from extending down too far relative to the drive shoe 13.

Each of the four bit segments 41 comprises an elongate body 47 having a base 48 (providing a support for a cutting element 49) at its lower end and an enlarged head 51 at its upper end. The cutting element 49 may be attached to base 48 by any suitable means such as brazing, welding, screwing or mechanical keying. The cutting element 49 has a cutting face 50 which defines the inner and outer radial limits of the annular hole to be drilled. The cutting face 50 may employ any suitable cutting medium such as diamond, tungsten carbide or a synthetic polycrystalline material.

The head 51 corresponds in shape to the recess 44 and has a rear surface formed with a convexly curved outer engagement section 52 which co-operates with the concavely curved support section 45. Together, the engagement section 52 and the support section 45 constitute a curved hinge profile by means of which the bit segment 41 can pivot between the outwardly extended drilling position and the retracted position.

When the segments 41 pivot, their elongate bodies 47 move freely into and out of the slots 43. They are prevented from falling into the interior of the bit housing 42 by the support section 45 and are prevented from falling out of position (particularly when the bit housing 42 is not enveloped by the drive shoe 13) by the circumferential spring 22.

It will therefore be appreciated that the bit segments 41 are maintained positively in their drilling position by the carrier tube 15 and are moved to their retracted position by a simple inward pivotal movement relative to the bit housing 42, allowed by the curved hinge profile 45,52 after the carrier tube 15 is withdrawn. As the bit housing 42 itself is withdrawn, inclined faces 53 on the lower ends of the bit segments 41 engage correspondingly inclined faces 54 on the drive shoe 13 forcing the bit elements to adopt their retracted position.

Perhaps more significant is the ease with which the bit segments 41 can be made to adopt the drilling position. Once the bit housing 42 is in position at the end of the drill line, the carrier tube is lowered to its end position and this automatically forces the drill segments 41 out into the drilling position. This is achieved without any translational motion relative to the bit housing 42 but by a pivotal motion alone.

Obviously, numerous modifications and variations of the present invention are possible in the light of the above teachings. It is therefore to be understood that within the scope of the appended claims, the invention may be practiced otherwise than as specifically described herein.

I claim:

1. A core sampling device for connection to a drilling machine through at least one drilling rod and an outer barrel attached to the drilling rod most distant from said drilling machine, said sampling device comprising a drill bit assembly, a generally cylindrical drive shoe drivingly coupled to said outer barrel and arranged to house said drill bit assembly, and a core sample tube; said drill bit assembly including a bit housing and a series of drill segments; said bit housing including first engagement means on an external surface thereof and said drive shoe including second engagement means on an internal surface thereof, whereby, when said bit housing is located within said drive shoe, said first and second engagement means engage each other so that when rotational force from said drilling machine is applied to said drive shoe via said drilling rods and said outer barrel, said bit housing is drivingly engaged by said drive shoe through the first and second engagement means; each drill segment comprising an elongate body having a laterally enlarged head at one end and the enlarged head having a rear surface formed with a convexly curved engagement section and a cutting portion at the other end, said cutting portion having an inner radial limit and an outer radial limit; said bit housing having a series of elongate slots, each slot being open at one end of said bit housing and having a laterally enlarged recess at the other end thereof and each recess defining a concavely curved internal support section around its front side conforming to the convexly curved engagement section; each drill segment being located with its elongate body within one of said elongate slots and with said curved engagement section slidably engaged with said curved support section of said recess to define a curved hinge profile whereby each drill segment is capable of pivoting, without any translation movement, relative to said bit housing between a drilling position, in which said outer and inner radial limits of said cutting portions define the outer and inner diameter of an annular hole to be drilled, and a retracted position in which said cutting faces are entirely within the diameter of said generally cylindrical drive shoe; said drill segments being maintained in said drilling position with said elongate bodies held in said elongate slots by means of said core sampling tube when said core sampling tube is in a forward position within said bit housing; means surrounding the bit housing and elongate bodies of the drill segments to maintain said engagement section in sliding engagement with said support section and said segments being allowed to adopt said retracted position with said elongate bodies extending into the interior of said bit housing when said sampling tube is withdrawn; said core sampling tube engaging said drill bit assembly whereby continued withdrawal of said core sampling tube causes withdrawal of said drill bit assembly from within said drive shoe.

2. A device according to claim 1 further including a retraction tube which is connected to said drill bit housing and which is engaged by said core sampling tube on its withdrawal in order to withdraw said drill bit assembly.

3. A device according to claim 2 wherein said core sampling tube houses a core spring.

4. A device according to claim 2 arranged to be connected to a drill line having an outer tube and an inner tube, wherein said drive shoe has a screw thread for connection to said outer tube of said drill line and said core sampling tube has connecting means for connection to said inner tube of said drill line.

5. A device according to claim 4 wherein said connecting means provides a connection allowing a limited rocking movement between said core sampling tube and said inner tube of said drill line.

* * * * *